US008951090B1

(12) United States Patent
LaCombe

(10) Patent No.: US 8,951,090 B1
(45) Date of Patent: Feb. 10, 2015

(54) DOLL OPERABLE TO STORE AND DISPLAY BABY TEETH

(71) Applicant: Peter LaCombe, Bellflower, CA (US)

(72) Inventor: Peter LaCombe, Bellflower, CA (US)

( * ) Notice: Subject to any disclaimer, the term of this patent is extended or adjusted under 35 U.S.C. 154(b) by 78 days.

(21) Appl. No.: 13/797,719

(22) Filed: Mar. 12, 2013

(51) Int. Cl.
*A63H 3/36* (2006.01)
*A63H 3/48* (2006.01)
*A63H 3/00* (2006.01)

(52) U.S. Cl.
CPC ..... *A63H 3/48* (2013.01)
USPC ..... 446/395; 446/337; 446/72

(58) Field of Classification Search
USPC ..... 446/27, 72, 73–75, 304, 391, 395, 337
See application file for complete search history.

(56) References Cited

U.S. PATENT DOCUMENTS 2,904,929 A * 9/1959 Weih ..... 446/395
4,231,181 A * 11/1980 Fabricant ..... 446/337
5,094,621 A * 3/1992 Friedel ..... 434/236
5,749,764 A * 5/1998 Bailey ..... 446/427

* cited by examiner

*Primary Examiner* — Kien Nguyen
(74) *Attorney, Agent, or Firm* — Gulf Coast Intellectual Property Group

(57) ABSTRACT

A toy doll that is operable to receive and display human infant teeth once they have been discharged from a human child. The toy doll further includes a body that is manufactured to resemble the anatomy of a human. The body further includes a head having an aperture that is formed to be shaped as an open human mouth. Disposed within the head accessible through the aperture are jaw members. The jaw members include an upper jaw member and a lower jaw member. The jaw members are independently removable and include a plurality of sockets that are operable to have human teeth releasably secured therein.

4 Claims, 1 Drawing Sheet

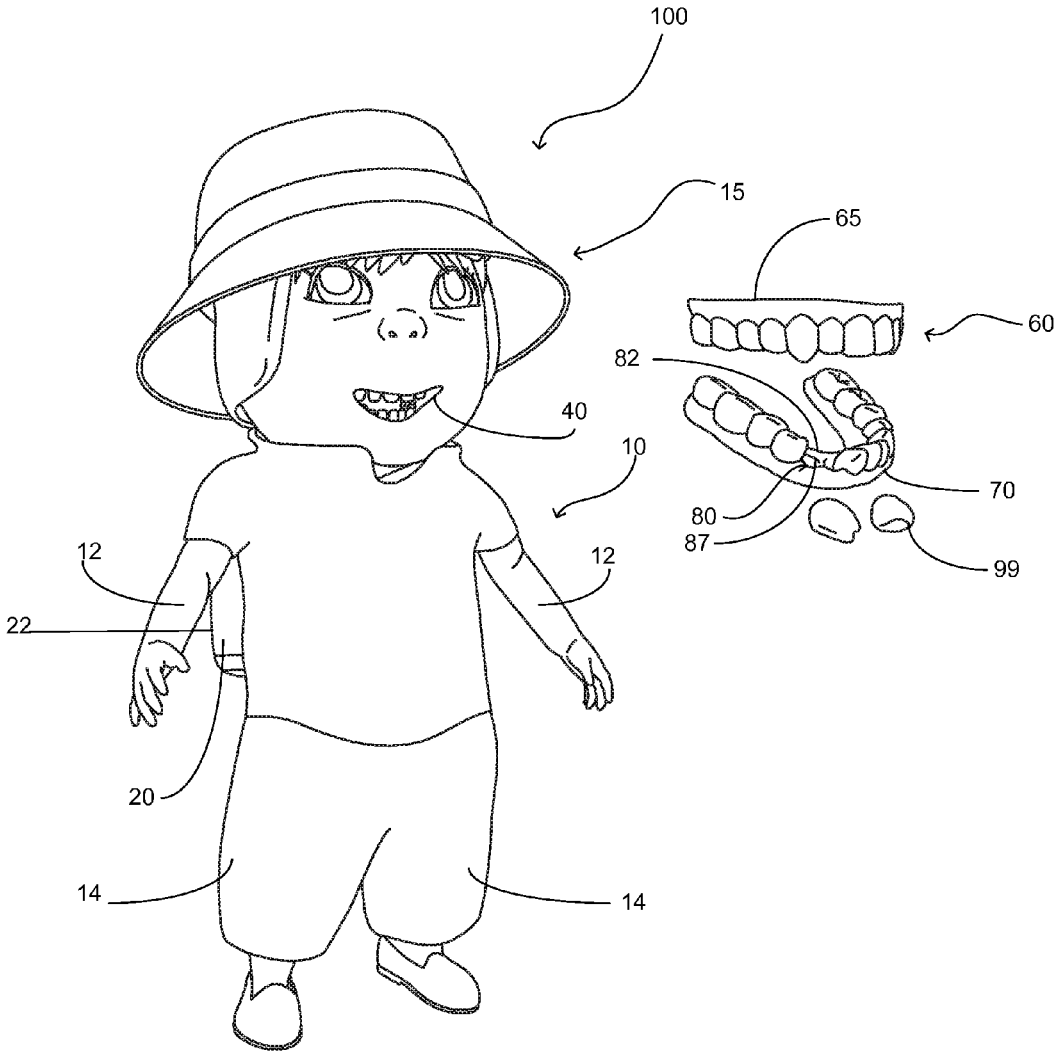
100
15
65
60
82
40
10
70
80
87
99
12
12
22
20
14
14

DOLL OPERABLE TO STORE AND DISPLAY BABY TEETH

FIELD OF THE INVENTION

The present invention relates to a doll, more specifically but not by way of limitation, a toy doll that is operable to store and display the teeth of an infant subsequent their removal from the infant.

BACKGROUND

There are numerous types of toy dolls that exist in the market for children today. Dolls are utilized not only for recreation but also for educational purposes. Doll examples include animated dolls that may make a particular sound subsequent being engaged therewith. Additionally, there are dolls that imitate bodily functions such as feeding and crying so as to teach the child playing with the doll methods on how to care for a simulated human infant.

It is further recognized within the art that existing technology within the field of invention includes dolls that perform speech in numerous different languages. A review of the existing technology in dolls will discover that there exists no dolls that are operable to store and display infant teeth once they have fallen out naturally or been extracted.

One problem encountered by many parents is what to do with the teeth from their child once they have fallen out or been removed. Many parents and/or cultures favor to keep the infant's teeth once the teeth have been removed from the child. Currently, devices such as keepsake boxes and the like are the only objects available for the storing of infant teeth once they have been removed from an infant. Typically, these types of devices are small and do not provide organization by tooth type of the recovered teeth.

Accordingly, there is a need for a doll that includes a removable jaw having receptacles that are operable to store and display teeth from an infant subsequent their removal from an infant.

BACKGROUND

It is the object of the present invention to provide a doll that is operable to receive, store and display infant teeth.

Another object of the present invention is to provide a doll that is operable to receive, store and display infant teeth that includes an upper jaw and a lower jaw.

Still a further object of the present invention is to provide a doll that is operable to receive human infant teeth and provide storage and display thereof wherein the upper jaw and lower jaw are configured to be removable.

A further object of the present invention is to provide a doll that is operable to receive, store and display human teeth wherein the upper jaw and lower jaw are operably independent and separately removable.

An additional object of the present invention is to provide a doll that is operable to receive human infant teeth and provide storage and display thereof wherein the doll further includes a notebook that functions as a journal providing a technique to record statistical information about the loss of the tooth from a child.

Yet another object of the present invention is to provide a doll that is operable to receive, store and display human infant teeth that has a plurality of external embodiments.

A further object of the present invention is to provide a doll that is operable to receive human infant teeth and provide storage and display thereof wherein the upper jaw and lower jaw have a plurality of receptacles that are operable to receive a tooth and retain therein.

Still another object of the present invention is to provide a doll that is operable to receive human infant teeth and provide storage and display thereof that is fun and inexpensive.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

FIG. 1 is a perspective view of an embodiment of the present invention; and

FIG. 1 further illustrates a detailed view of the upper and lower jaw of the present invention.

DETAILED DESCRIPTION

Referring now to the drawings submitted herewith, wherein various elements depicted therein are not necessarily drawn to scale and wherein through the views and figures like elements are referenced with identical reference numerals, there is a toy doll 100 constructed according to the principles of the present invention.

Referring to the Figures herein, the toy doll 100 further includes a body 10 being manufactured from a suitable durable material such as but not limited to plastic. The body 10 is shaped in human form having arms 12, legs 14, and a head 15. It is contemplated within the scope of the present invention that the body 10 could be manufactured in numerous different sizes and lengths. Additionally, it is contemplated within the scope of the present invention that the body 10 could be shaped so as to portray a masculine figure or a feminine figure. Furthermore, it is contemplated within the scope of the present invention that the body 10 could be manufactured and adorned with garments so as to portray sports figures and other figures such as but not limited to political figures. While in the preferred embodiment the body 10 is formed to resemble the anatomy of a human being, it is additionally contemplated within the scope of the present invention that the body 10 could be formed to resemble either just a portion of an anatomical feature of a human such as but not limited to a head or skull. It is further contemplated within the scope of the present invention that the body 10 could be configured to be structured with a lower cavity and aperture similar to a hand puppet in order to allow a user to utilize the toy doll 100 as a hand puppet.

Releasably secured to the body 10 is a storage compartment 20. The storage compartment 20 is generally square in shape and is manufactured from a suitable durable material such as but not limited to cloth and includes a plurality of walls 22 formed to create an interior volume. While not specifically illustrated herein, the storage compartment 20 includes an opening 24 permitting access to an interior volume of the storage compartment 20. It is contemplated within the scope of the present invention that the storage compartment 20 further includes a flap or similar element that is flexible in manner and is operable to substantially cover the opening. The storage compartment 20 is manufactured of suitable size so as to accommodate a notebook journal or other similar item therein. Those skilled in the art will recognize that the storage compartment 20 could be manufactured in numerous different sizes and further be manufactured from a plurality of materials. Furthermore, while in the preferred embodiment herein only one storage compartment 20 is depicted, it is contemplated within the scope of the present invention that more than one storage compartments 20 could be releasably secured to the body 10. Additionally, while the preferred embodiment of the storage compartment 20 is generally square in shape, it is contemplated within the scope of the present invention that the storage compartment 20 could be formed in numerous different shapes.

The head 15 further includes aperture 40. The head 15 is substantially hollow. Aperture 40 is formed to resemble a human mouth. The aperture 40 is formed so as to maintain a representation of an open human mouth. This position is desirable so as to display the exemplary human teeth 99. The aperture 40 provides access to a cavity (not particularly illustrated herein) wherein the jaw members 60 are releasably secured. The jaw members 60 illustrated in FIG. 2, include an upper jaw member 65 and a lower jaw member 70. The jaw members 60 are manufactured from a suitable durable material such as but not limited to plastic. The upper jaw member 65 and lower jaw member 70 are independently operable of each other and are separately secured within the cavity of the head 15. The jaw members 60 are secured within the head 15 utilizing suitable mechanical fasteners that allow for the repeated removal and replacement thereof. Those skilled in the art will recognize that numerous types of mechanical fasteners could be utilized to secure the jaw members 60 within the head 15. The jaw members 60 are manufactured from a suitable durable material such as but not limited to plastic or silicone.

The jaw members 60 further include a plurality of receptacles 80. The receptacles 80 are formed in the jaw members 60 and are operable to receive the exemplary human teeth. The walls 82 of the receptacles 80 are resilient in manner in order to allow the receptacles 80 to maintain a bias against an exemplary tooth 99 subsequent the exemplary tooth 99 being placed within the receptacle 80. Furthermore, each receptacle 80 contains surface undulations 87 that are designed to match the surface structure of the various types of human teeth so as to create a more mateable surface therewith. It is further contemplated within the scope of the present invention that the exemplary tooth 99 could be secured within the receptacle 80 utilizing chemical adhesion or a mechanical fastener. While no specific quantity of receptacles are required, it is contemplated within the scope of the present invention that the jaw members 60 have at least twenty receptacles across the upper jaw member 65 and lower jaw member 70 so as to have a sufficient amount of receptacles 80 to store the average quantity of human baby teeth.

Referring to the Figures herein, a description of the operation of the toy doll 100 is as follows. In use, a user will utilize the toy doll 100 to store and display human baby teeth subsequent their loss by a child. A user will remove either the upper jaw member 65 or lower jaw member 70 through the aperture 40 depending upon which exemplary tooth 99 was lost by a child. Ensuing the removal of one of the jaw members 60, the user will secure the exemplary tooth 99 in the desired receptacle 80 wherein the exemplary tooth 99 is releasably secured as discussed herein. Subsequent the placement of the exemplary tooth 99 in a receptacle 80, the jaw member 60 is replaced into the head 15 of the toy doll 100 and the toy doll 100 is then positioned for display by the user.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A toy doll manufactured in a human anatomical form operable to receive an display human baby teeth comprising:

a body, said body having a first arm and a second arm, said body having a first leg and a second leg, said body being formed to anatomically resemble a human being said body having a first end and a second end;

a head, said head being secured proximate said first end of said body, said head being substantially hollow;

an aperture, said aperture being formed on said head, said aperture being shaped to resemble an open human mouth;

an upper jaw member, said upper jaw member being releasably secured within said head of said body, said upper jaw member configured to have human teeth releasably secured thereto, said upper jaw member further containing a plurality of receptacles, said plurality of receptacles operable to releasably secure a human tooth therein, said plurality of receptacles having surface undulations, said surface undulations being shaped to match the surface structural shape of various types of human teeth so as to mateably engage therewith; and a lower jaw member, said lower jaw member being releasably secured within said head of said body, said lower jaw member configured to have human teeth releasably secured thereto, said lower jaw member further containing a plurality of receptacles, said plurality of receptacles operable to releasably secure a human tooth therein, said plurality of receptacles having surface undulations, said surface undulations being shaped to match the surface structural shape of various types of human teeth so as to mateably engage therewith.

2. The toy doll as recited in claim 1, wherein said plurality of receptacles further include walls, said walls being resilient in manner.

3. The toy doll as recited in claim 2, and further including a storage compartment, said storage compartment being square in shape, said storage compartment being releasably secured to said body, said storage compartment having an opening and an interior volume operable to receive a notebook.

4. The toy doll as recited in claim 3, wherein said toy doll is manufactured to resemble a human of at least one of the following types: masculine or feminine.

* * * * *